US005801524A

United States Patent [19]

Boerstler

[11] Patent Number: 5,801,524

[45] Date of Patent: Sep. 1, 1998

[54] VOLTAGE CONTROLLED CURRENT SOURCE FOR LOW VOLTAGE APPLICATIONS

[75] Inventor: David Boerstler, Round Rock, Tex.

[73] Assignee: International Business Machines Corporation, Armonk, N.Y.

[21] Appl. No.: 863,151

[22] Filed: May 27, 1997

[51] Int. Cl.[6] ..... G05F 3/26

[52] U.S. Cl. ..... 323/315; 323/316

[58] Field of Search ..... 323/312, 315, 323/316, 317; 327/530, 538, 317; 330/252, 253, 254, 257, 260

[56] References Cited

U.S. PATENT DOCUMENTS

| | | | |
|---|---|---|---|
| 3,904,988 | 9/1975 | Hsiao | 331/111 |
| 3,947,778 | 3/1976 | Hsiao et al. . | |
| 4,048,575 | 9/1977 | Musa . | |
| 4,240,039 | 12/1980 | Mihalich . | |
| 4,554,515 | 11/1985 | Burson et al. . | |
| 4,766,394 | 8/1988 | Yukawa | 330/253 |
| 4,791,324 | 12/1988 | Hodapp | 307/530 |
| 4,797,631 | 1/1989 | Hsu et al. . | |
| 4,887,048 | 12/1989 | Krenik et al. . | |
| 4,958,133 | 9/1990 | Bazes . | |
| 5,280,199 | 1/1994 | Itakura . | |
| 5,321,370 | 6/1994 | Yukawa . | |
| 5,323,120 | 6/1994 | Ryat . | |
| 5,334,948 | 8/1994 | Fong et al. . | |
| 5,392,003 | 2/1995 | Nag et al. . | |
| 5,461,336 | 10/1995 | Yada | 327/533 |
| 5,465,070 | 11/1995 | Koyama et al. | 327/350 |
| 5,500,624 | 3/1996 | Anderson . | |
| 5,528,185 | 6/1996 | Lewicki et al. . | |
| 5,550,510 | 8/1996 | Nagaraj . | |
| 5,554,951 | 9/1996 | Gough . | |
| 5,596,302 | 1/1997 | Mastrocola et al. . | |
| 5,600,284 | 2/1997 | Nguyen et al. . | |
| 5,696,459 | 12/1997 | Neugebauer | 327/108 |

OTHER PUBLICATIONS

IBM Technical Disclosure Bulletin, "Method of Extending OP AMP Input Signal Range", vol. 35, No. 7, Dec. 1992.

John F. Ewen et al., IEEE International Solid-State Circuits Conference, "Single-Chip 1062 Mbaud CMOS Transceiver for Serial Data Communication", Session 2, Data Commuications, p. 32-33, 1995.

Ali Motamed et al., IEEE, "A Programmable Low-Voltage Micropower CMOS Input Stage Architecture", pp. 148-149, 1996.

*Primary Examiner*—Adolf Berhane

*Attorney, Agent, or Firm*—Casimer K. Salys; Alan L. Carlson; Andrew J. Dillon

[57] ABSTRACT

A differential input, voltage controlled current source utilizing a low supply voltage and realizing a wide common mode input range. The voltage controlled current source provides a differential output current as a function the differential input voltage which is independent of the common mode input voltage level. The voltage controlled current source includes a first and a second differential amplifier receiving the differential input voltage and producing a differential current having a first and second leg. The first leg of the differential output current is tracked by a current mirror which floats as a function of the bias voltage and common mode input voltage. A second floating current mirror tracks the second differential output current leg. The first and second current mirrors are coupled to a replica bias circuit which is connected in parallel with the differential amplifiers. The replica bias and first and second current mirrors are connected across the supply voltage and not cascaded with other circuit functions, making the present invention compatible with low voltage technologies.

13 Claims, 2 Drawing Sheets

VOLTAGE CONTROLLED CURRENT SOURCE FOR LOW VOLTAGE APPLICATIONS

CROSS REFERENCE TO RELATED APPLICATION

The present application is related to copending U.S. patent application Ser. No. 08/863.152 filed on an even date herewith and assigned to the assignee hereon named. The content of the copending application is hereby incorporated herein by reference thereto.

BACKGROUND OF THE INVENTION

1. Technical Field

The present invention relates, in general, to voltage controlled current sources and in particular to low voltage technology differential path current sources. Still more particularly, the present invention relates to differential path voltage controlled current sources, capable of realizing a wide common mode input voltage range, for supplying mixer circuits, oscillator, delay or other circuits using low voltage technology.

2. Description of the Related Art

Efforts to decrease the size and increase the speed of electrical circuits have created the need for low voltage silicon devices. Many electronic devices are now portable and utilize battery power. Lower voltage results in lower power consumption.

Lower operating voltage also provides for faster circuits. The voltage applied across a semiconducting device is directly related to its maximum switching frequency. The amount of charge left in a semi-conducting device or transistor when switching to an off state is a function of operating voltage. The charge within the transistor decays as a function of time and inherent device capacitance. Hence, lower operating voltages provide less charge for the device capacitance to hold and switching can occur at a much faster rate. There is a minimum limit on the voltage level which circuits will effectively operate since most CMOS transistors have a threshold voltage of approximately 0.3 V to 0.7 V. Therefore, the practical minimum operating voltage of a silicon chip is a few volts. The current low voltage standards are 1.8 V and 3.3 V. In the prior art of signal conditioning circuits, transistors are cascaded or stacked in multiple levels to achieve multiple functions between the high supply voltage and the low supply voltage.

Conventional cascaded structures perform sufficient conditioning and mixing functions, but require higher supply voltages. This is due to the vertical cascoding or stacking of four or more active devices on a silicon wafer. Usage of these cascaded circuits is limited to older higher voltage technologies. Other methods have been used to overcome this problem, such as level shifting and other maintenance circuits. These methods add complexity, cost and unreliability.

Further, differential control path circuits require external common mode voltage sensing and circuit compensation techniques to function effectively. Common mode sensing circuits compensate for undesirable biasing created by the common mode component of the input control voltage. Presently available, differential path circuits have relatively high voltage requirements or inefficient appendage circuits. Generally, as the input common mode voltage changes, appendage circuits are slow to respond and can create instability in the system. Another problem which may occur, is loss of data because a circuit has not reached a steady state. These external compensation methods also introduce system non-linearity due to subordinate circuit design.

Presently, internal compensation methods for adjusting to common mode input variations involve cascading a minimum of 4 to 5 levels of active devices.

Hence, retaining functionality and optimum performance while reducing the number of cascaded levels to accommodate low voltage technologies is desirable and advantageous. The present invention is directed at solving the incompatibility problem that exists between differential signal technology and state of the art low voltage digital and analog circuitry.

SUMMARY OF THE INVENTION

It is therefore one object of the present invention to provide reliable support for low voltage circuits utilizing differential path configurations.

It is another object of the present invention to provide accurate reliable methods of adjusting for common mode variations of a differential input.

It is yet another object of the present invention to provide a low supply voltage differential input voltage controlled current source allowing a wide rail to rail common mode input range.

The foregoing objects are achieved as is now described. A differential input, voltage controlled current source utilizing a low supply voltage and realizing a wide common mode input range is provided. The voltage controlled current source provides a differential output current as a function of the differential input voltage which is independent of the common mode input voltage level. The voltage controlled current source includes a first and a second differential amplifier receiving the differential input voltage and producing a differential current having a first and second leg. The first leg of the differential output current is tracked by a current mirror which floats as a function of the bias voltage and common mode input voltage. A second floating current mirror tracks the second differential output current leg. The first and second current mirrors are coupled to a replica bias circuit which is connected in parallel with the differential amplifiers. The replica bias and first and second current mirrors are connected across the supply voltage and not cascaded with other circuit functions, making the present invention compatible with low voltage technologies.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT

Figure 1:
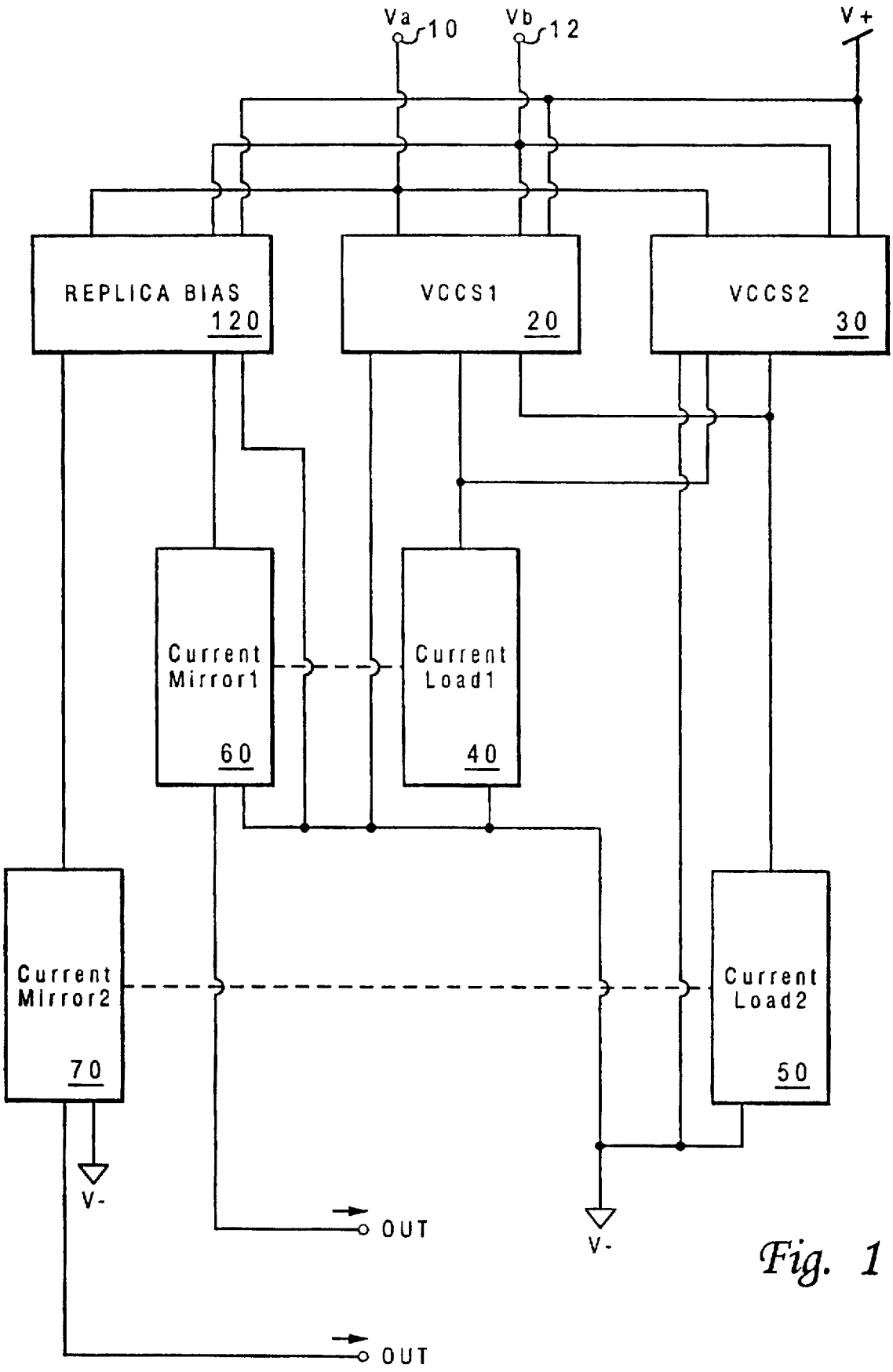
FIG. 1 depicts a block diagram of a low voltage differential voltage, controlled current source with paralleled powered current mirrors in accordance with the present invention.

With reference now to the figures and in particular with reference to FIG. 1, a low voltage differential input controlled current source with parallel powered current mirrors is depicted. Power is supplied to the current source on terminals V+ and V−. A differential input voltage (Va−Vb) is applied across input terminals Va 10 and Vb 12. A first voltage controlled current source (VCCS1) 20 fully conducts a differential current, responsive to the differential input voltage, when the common mode voltage component of the input signal is high. A second voltage controlled current source (VCCS2) 30 fully conducts a differential current responsive to the differential input voltage when the common mode voltage component of the input signal is low. Current load1 40 receives the first output leg of VCCS1 20 and VCCS2 30. Current load2 50 receives the second output leg of VCCS1 20 and VCCS2 30.

When the common mode component of the differential input voltage is close to supply voltage low (V−), VCCS1 20 will shut down. When the common mode component is close to supply voltage high (V+), VCCS2 30 will shut down. When the common mode voltage is between the high supply level and the low supply level, each differential amplifier contributes a portion of the current to each current load. The trans-conductance condition is well controlled since there is substantial overlap between the operating ranges of each VCCS1 20 and VCCS2 30. The present invention will operate properly for an input signal (differential input voltage) having virtually any common mode voltage between V+ and V−. The high and low outputs of VCCS1 20 and VCCS2 30 are individually joined, so that they add constructively.

Current mirror1 60 replicates the current flow in current load1 40. Current mirror2 70 replicates the current flow in current load2 50. Current mirrors 60 and 70 are connected to replica bias circuit 120. This ensures that the current mirroring devices 60 and 70 are modulated substantially similarly to VCCS1 20 and VCCS2 30. Current mirroring requires proper fabrication techniques and identical gate to source voltages. Hence, the present invention produces a differential current on its output which is a function of the differential input voltage and independent of the common mode voltage of the input signal.

Figure 2:
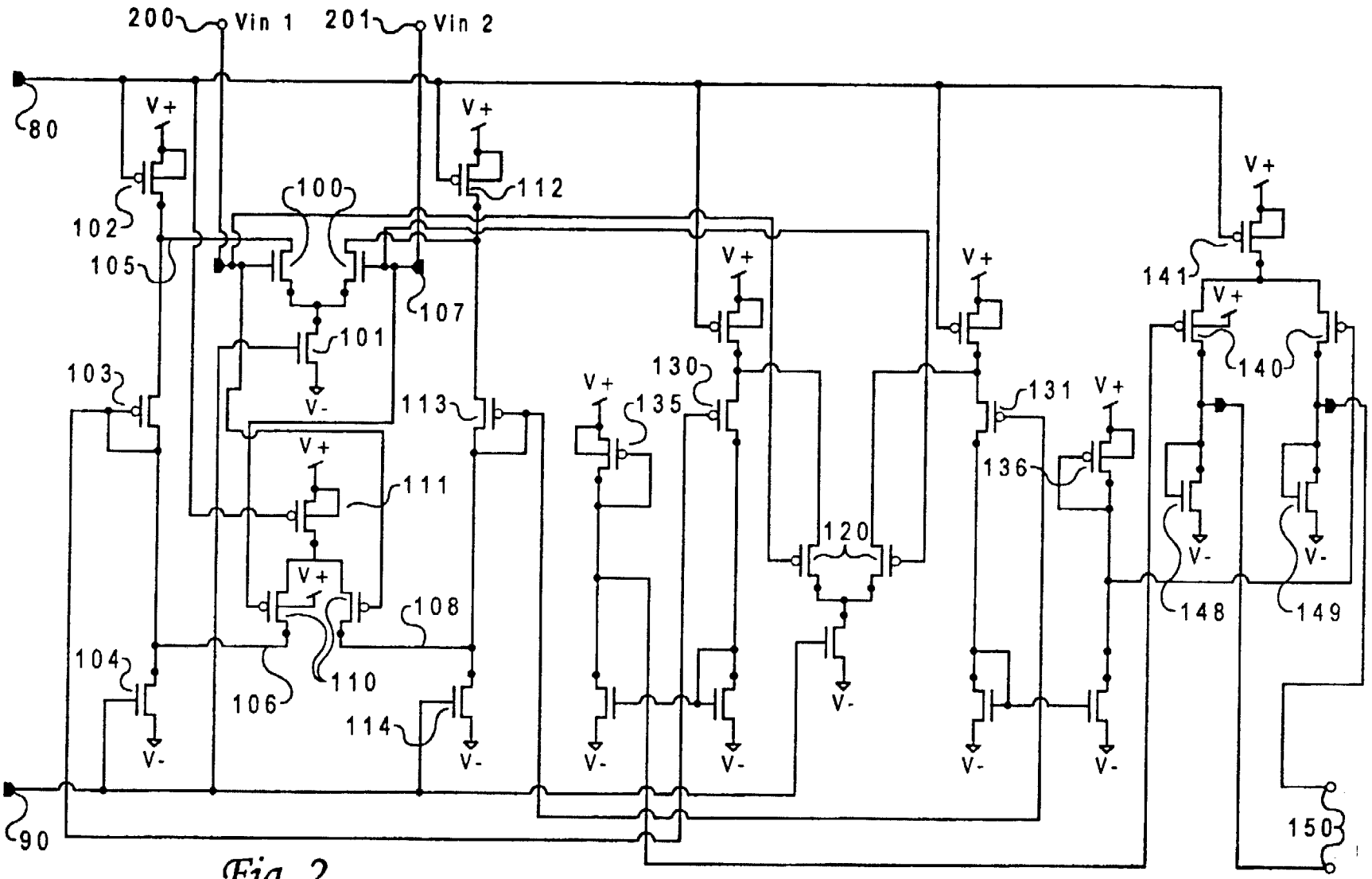
FIG. 2 illustrates a more detailed diagram of the present invention depicting an implementation with only three levels of cascoding in accordance with the present invention.

FIG. 2 illustrates a more detailed diagram in accordance with the present invention. In a preferred embodiment a bias voltage supplies power. Bias voltage is measured across a supply voltage high Vp 80 and supply voltage low Vn 90. The bias voltage can be generated by a reference circuit (not shown) which compensates for temperature swings, process variations, and other parameters. Vin1 200 and Vin2 201 provide a differential input signal which supplies the gates of a first differential amplifier 100, a second differential amplifier 110 and a replica bias circuit 120. In a preferred embodiment, the differential input signal is filtered by a differential filter (not shown) to reduce noise on the input signal. Vp 80 and Vn 90 bias differential amplifiers 100 and 110 and replica bias circuit 120. In a preferred embodiment, differential amplifier 100 is comprised of two source coupled N-FET transistors. Differential amplifier 110 is comprised of two source coupled P-FET transistors. A first current source 101 attached to differential amplifier 100 determines the gain or sensitivity of differential amplifier 100. A second current source 111 attached to differential amplifier 110 determines the gain or sensitivity of differential amplifier 110.

Load transistors 103 and 113 perform as a load for the sum of the differential currents produced by each differential amplifier 100 and 110. The first outputs 105 and 106 and second outputs 107 and 108 of differential amplifiers 100 and 110 are connected such that their signals will add constructively across load transistors 103 and 113. Current sourcing transistors 102 and 112 are of sufficient size to supply twice the current in differential amplifiers 100 and 110. Likewise, current sinking transistors 104 and 114 are of sufficient size to sink twice the current in differential amplifiers 100 and 110.

Effectively, the current in load transistors 103 and 113 is equal to the sum of the current modulation through differential amplifiers 100 and 110. The width/length ratio of the source coupled pairs of differential amplifiers 100 and 110 are reduced to create a linear response or amplification. Since the ratio of the differential amplifiers 100 and 110 is balanced, the modulation current through the load transistors 103 and 113 is independent of the common mode input voltage. Therefore, the total current supplied by the differential amplifiers 100 and 110 to both load transistors 103 and 113 is a substantially constant value, independent of common mode input voltage. However, the amount of current contributed by each individual differential amplifiers 100 and 110 to each load transistor 103 and 113 is a function of common mode input voltage. Each load transistor 103 and 113 receives a different magnitude of current responsive to the differential input voltage. In summary, the magnitude of the differential current is a function of the input signal and independent of common mode input voltage.

The N-well connection of differential amplifier 110 is tied to V+ rather than to a common source so the P-FET thresholds will change with common mode input voltage. First differential amplifier 100 is also connected in this configuration. The trans-conductance is well controlled in the present invention, since there is substantial overlap in the P-FET and N-FET operating ranges.

In a preferred embodiment, only three transistors or active devices exist between supply voltage high Vp 80 and supply voltage low Vn 90. Stated another way, the present invention is implemented cascoding only three active devices.

Current mirrors 130 and 131 mirror the current on load transistors 103 and 113, respectively. Current mirrors 130 and 131 must have a substantially identical gate to source voltage or bias to accurately mirror or replicate the current in the load transistors 103 and 113. A replica bias circuit 120 is utilized for simultaneously modulating two current mirrors 130 and 131 responsive to the input signal. In a preferred embodiment, a N-FET source coupled pair is used rather than a P-FET source coupled pair to provide a higher input impedance and keep the input loading low.

In a preferred embodiment of the present invention, current mirrors 130 and 131 are again mirrored by transistors 135 and 136. At the source connections of current mirrors 130 and 131, a differential signal voltage is produced. The signal voltage supplies output source coupled pair 140.

Output source coupled pair 140 is biased by constant current tail device 141. In a preferred embodiment, an output source coupled pair 140 is utilized to generate a full current swing of tail device 141 through load transistors 148 and 149. A current output is produced 150 which is transparent to the common mode voltage on the input signals 200 and 201.

Again, no more than three active devices are present between Vp 80 and Vn 90. The present invention is particularly useful to supply phase mixing circuits. Phase mixing circuits are often used in voltage controlled oscillators and voltage controlled delay lines. For a good example of a circuit which could effectively utilize the present invention, see the cross referenced patent application Ser. No.

08/863152, entitled Low Voltage Phase Mixing Apparatus, by the same inventor as the present invention, filed of even date herewith.

While the invention has been particularly shown and described with reference to a preferred embodiment, it will be understood by those skilled in the art that various changes in form and detail may be made therein without departing from the spirit and scope of the invention.

What is claimed is:

1. A voltage controlled current source utilizing a low supply voltage and a differential input voltage comprising:

a first and a second differential amplifier coupled to a differential input voltage for producing a differential current which is a function of said differential input voltage and independent of a common mode input voltage, said differential current having a first current and a second current;

a first floating current mirror responsive to said first current;

a second floating current mirror responsive to said second current; and wherein said first and said second floating current mirrors are coupled independently of said first and second differential amplifier to said low supply voltage, allowing utilization of low voltage technology.

2. The voltage controlled current source according to claim 1, wherein an output of said voltage controlled current source remains substantially linear while the common mode input voltage of the differential input voltage ranges from supply voltage high to supply voltage low.

3. The voltage controlled current source according to claim 1, wherein the first differential amplifier is a source coupled N-FET.

4. The voltage controlled current source according to claim 1, wherein the second differential amplifier is a source coupled P-FET.

5. The voltage controlled current source according to claim 1, wherein the first and second floating current mirrors are biased by a replica bias circuit.

6. The voltage controlled current source according to claim 5, wherein said replica bias circuit is a source coupled N-FET pair.

7. The voltage controlled current source according to claim 1, wherein the first and second floating current sources are mirrored by a third and fourth current source.

8. The voltage controlled current source according to claim 1, wherein first and second current mirrors operate responsive to a voltage.

9. The voltage controlled current source according to claim 1, wherein first and second current source drive an output source coupled pair.

10. The voltage controlled current source according to claim 1, wherein output source coupled pair is responsive to a voltage.

11. The voltage controlled current source according to claim 1, wherein output source coupled pair drives a phase mixing apparatus.

12. The voltage controlled current source according to claim 1, wherein output source coupled pair drives a voltage controlled delay line.

13. The voltage controlled current source according to claim 1, wherein output source coupled pair drives an oscillator device.

* * * * *